US009095231B2

(12) United States Patent
Abdo

(10) Patent No.: US 9,095,231 B2
(45) Date of Patent: Aug. 4, 2015

(54) PILLOW

(76) Inventor: John S. Abdo, Marina Del Rey, CA (US)

( * ) Notice: Subject to any disclaimer, the term of this patent is extended or adjusted under 35 U.S.C. 154(b) by 539 days.

(21) Appl. No.: 13/442,484

(22) Filed: Apr. 9, 2012

(65) Prior Publication Data

US 2012/0255126 A1 Oct. 11, 2012

Related U.S. Application Data

(60) Provisional application No. 61/473,560, filed on Apr. 8, 2011.

(51) Int. Cl.
*A47G 9/10* (2006.01)
*A47C 7/38* (2006.01)
*A47C 20/02* (2006.01)

(52) U.S. Cl.
CPC ..... *A47G 9/1009* (2013.01); *A47C 7/383* (2013.01); *A47C 20/02* (2013.01); *A47G 9/109* (2013.01)

(58) Field of Classification Search
CPC ..... A47G 9/10; A47G 9/1081; A47G 9/109; A47C 7/383; A47C 7/38; A47C 20/026; A47C 20/00
USPC ..... 5/636, 638, 640, 643, 652, 657; D6/601
See application file for complete search history.

(56) References Cited

U.S. PATENT DOCUMENTS 1,386,652 A * 8/1921 Patton ..... 5/640
2,940,088 A * 6/1960 Boos ..... 5/636
3,482,571 A * 12/1969 Behrendt ..... 128/202.18
3,574,397 A * 4/1971 Norriss ..... 297/391
3,757,365 A * 9/1973 Kretchmer ..... 5/636
4,320,543 A * 3/1982 Dixon ..... 5/637
4,790,042 A * 12/1988 Reich ..... 5/655

(Continued)

FOREIGN PATENT DOCUMENTS

CN 2315844 Y 4/1999
CN 2862868 Y 1/2007

(Continued)

OTHER PUBLICATIONS

PCT International Search Report. Application No. PCT/US2012/032745. Jun. 25, 2013.

(Continued)

*Primary Examiner* — Robert G Santos
(74) *Attorney, Agent, or Firm* — Peter J. Ims; Westman, Champlin & Koehler, P.A.

(57) ABSTRACT

A pillow includes an upper surface having a raised edge proximate the upper and lower edges of the upper surface and at least one cut out through one of the raised edges. The pillow includes a recessed surface in the upper surface for supporting the back surface of the user's neck and cranium and the sides of the user's head. The pillow includes at least one internal armature that is flexible and bendable such that the pillow can be manipulated into a selected configuration with manual force. The pillow can be configured from a substantially flat configuration and into a substantially "U" shape where left and right edges are in front of the user's face. In the "U" shaped configuration, the user can roll from side to side while the pillow remains in direct contact and rolls uniformly with the user's head maintaining support for both the neck and head and thereby provide a more comfortable rest or sleep.

18 Claims, 10 Drawing Sheets

(56) References Cited

U.S. PATENT DOCUMENTS

| | | | | | |
|---|---|---|---|---|---|
| 5,018,231 | A * | 5/1991 | Wang | 5/636 |
| 5,163,194 | A | 11/1992 | Dixon | |
| 5,371,909 | A * | 12/1994 | McCarty | 5/655 |
| 5,457,832 | A * | 10/1995 | Tatum | 5/636 |
| D381,233 | S * | 7/1997 | Torbik | D6/601 |
| D388,648 | S * | 1/1998 | Bates | D6/601 |
| D388,650 | S * | 1/1998 | Davis | D6/601 |
| 5,708,998 | A * | 1/1998 | Torbik | 5/636 |
| 5,743,271 | A * | 4/1998 | Royo-Salvador | 128/845 |
| D395,568 | S * | 6/1998 | Davis | D6/601 |
| 5,781,947 | A * | 7/1998 | Sramek | 5/636 |
| 5,926,880 | A * | 7/1999 | Sramek | 5/636 |
| 6,006,380 | A * | 12/1999 | Sramek | 5/636 |
| D444,980 | S * | 7/2001 | Mowat et al. | D6/601 |
| 6,381,784 | B1 * | 5/2002 | Davis et al. | 5/636 |
| 6,449,788 | B1 * | 9/2002 | Nichols | 5/636 |
| 6,471,726 | B2 * | 10/2002 | Wang | 5/636 |
| 6,658,681 | B2 * | 12/2003 | Britto et al. | 5/655 |
| 7,082,633 | B1 * | 8/2006 | Maarbjerg | 5/636 |
| D529,325 | S * | 10/2006 | Maarbjerg | D6/601 |
| 7,185,378 | B2 * | 3/2007 | Smith | 5/642 |
| D558,499 | S * | 1/2008 | Maarbjerg et al. | D6/601 |
| 7,316,041 | B2 * | 1/2008 | Guez | 5/636 |
| 7,516,504 | B2 * | 4/2009 | Guez | 5/636 |
| 7,588,291 | B2 * | 9/2009 | Gold et al. | 297/219.12 |
| D618,943 | S * | 7/2010 | Gold et al. | D6/596 |
| D634,960 | S * | 3/2011 | Anson | D6/601 |
| D645,693 | S * | 9/2011 | Rothbard | D6/601 |
| 8,161,588 | B1 * | 4/2012 | Anson | 5/636 |
| 8,677,531 | B2 * | 3/2014 | Popitz | 5/638 |
| 2002/0138907 | A1 * | 10/2002 | Wang | 5/636 |
| 2003/0196269 | A1 * | 10/2003 | Britto et al. | 5/636 |
| 2004/0039316 | A1 * | 2/2004 | Smith | 602/6 |
| 2006/0174414 | A1 * | 8/2006 | Maarbjerg | 5/636 |
| 2007/0006382 | A1 * | 1/2007 | Guez | 5/638 |
| 2008/0092296 | A1 * | 4/2008 | Guez | 5/636 |
| 2009/0001801 | A1 * | 1/2009 | Gold et al. | 297/452.47 |
| 2012/0180220 | A1 * | 7/2012 | Popitz | 5/638 |
| 2012/0255126 | A1 * | 10/2012 | Abdo | 5/638 |
| 2015/0040322 | A1 * | 2/2015 | Cheng et al. | 5/638 |

FOREIGN PATENT DOCUMENTS

| | | | |
|---|---|---|---|
| DE | 3627286 | A1 | 2/1988 |
| JP | 2002017542 | A | 1/2002 |
| JP | 2007082590 | A | 4/2007 |

OTHER PUBLICATIONS

Chinese Office Action from corresponding Chinese Patent Application No. 201280017438.X, mailed Jul. 24, 2014.

Extended European Search Report and Written Opinion from corresponding European Patent Application No. 12863421.9, mailed Aug. 18, 2014.

Second Chinese Office Action from corresponding Chinese Patent Application No. 201280017438.X, mailed Mar. 12, 2015 (24 pages).

* cited by examiner

PILLOW

CROSS REFERENCE TO RELATED APPLICATION(S)

This application claims the benefit of U.S. Provisional Application Ser. No. 61/473,560 which was filed on Apr. 8, 2011, the contents of which are incorporated by reference in its entirety.

BACKGROUND

The present invention relates to a pillow. More particularly, the present invention relates to a pillow that is configured to anatomically and comfortably support the face, jaw, neck and head while being capable of being manipulated with manual force into numerous configurations and maintains the selected configurations of the user.

There are many adjustable and fixed U-shaped pillows that are positioned around a person's neck that do not extend upwardly to also contact, surround and/or support the bottom, front, back and sides of the user's head. A pillow that wraps only about the neck, and does not extend about the head, leaves the head unsupported and susceptible to tilting and/or wobbling forward, rearward and to either side of the cranium's cervical/neck axis. When the individual is positioned in an upwardly angled reclined position or a substantially vertical sitting position, like sitting, relaxing or sleeping in an airplane seat, propped up on a sofa or in a bed watching TV or reading, the circumference of their head/cranium is unsupported and susceptible to tilting and/or wobbling off its cervical axis. When a person attempts to lay down in a prone position utilizing such a U-shaped pillow, the pillow, due to its lack of head, skull or cranium support, will cause a substantial amount of rearward bending in the cervical/cranium neck region as the distance between the back of the head to the sleeping or resting surface will be excessive which causes the cranium, cervical vertebra of the neck, thoracic vertebra of the upper back, and associated tissues to compress and distort. The compression and distortion of the cranium with respect to the cervical vertebra of the neck, the thoracic vertebra of the upper back and associated tissues could lead to discomfort, misalignment, pain and injury to the individual along with a lower quality of sleep.

Further, the U-shaped pillow is intended to stabilize the head in an upright, linear position but fails to support and/or immobilize the head from leaning or tilting laterally from side-to-side, such as sleeping on an airplane seat or propped up on a sofa or in a bed watching TV or reading. The wrap-around-the-neck U-shape design does not prevent head and neck movement. When it is not supported, the user's head can fall forward and also tilt laterally to one side or the other when in a seated or reclined position. If the head of the user tilts or sways to one side or the other in a rapid action, like the seconds prior to falling asleep, or is laying in this position for any extended period of time, the jaw, neck and its vertebra, nerves and tissues will be substantially misaligned, flexed and/or compressed, which can result in poor anatomical posture, discomfort, sleep disturbance, injury and/or pain to the individual.

With regard to standard "flat" pillows, which typically lay on top the bed, these pillows are intended for the sleeper to lay his/her head on the top of the pillow's surface. The pillow remains in the same position on top of the bed however if the sleeper tosses and turns, or shifts their head and body to either side, it is possible for the sleeper's head to travel to either another part of the pillow, wobble off the edge of the pillow, and/or their head can totally disengage from the pillow, causing the head to fall off the pillow and into an unnatural misaligned tilted position resulting in poor anatomical posture that will cause compression and potential injury in the jaw and cranium/cervical/thoracic regions similar to the effect of the compression and tilt of sleeping in a prone position with a wrap-around-the-neck designed pillow.

There are many instances when a person desires to conform a standard flat pillow into a configuration other than that of a flat pillow, such as to muffle noise and/or to block out light when sleeping by manually having to hold the pillow onto one or both ears and eyes. In order for a standard flat pillow to maintain any desired configuration other than flat, the person must maintain a physically energy-exerting force on the pillow, which in many instances is not possible due to the person attempting to sleep. As such, a standard flat pillow, in many instances is not capable of meeting the person's needs.

SUMMARY

The present invention relates to a pillow that includes an upper surface, a lower surface and side edges. At least the upper surface includes a raised edge proximate the upper and lower edges of the upper surface. The upper surface includes at least one cut out through either the raised edge proximate the upper or lower edge that is configured to support the user's neck in an anatomically correct position. A recessed surface in the upper surface for supporting the back surface of the user's cranium and the sides of the user's face, jaw and head extends from proximate a left edge to proximate a right edge and is in communication with the at least one cut out. The pillow is of a sufficient height to extend from the user's lower neck upper back region to above the user's ears, face and at least proximate the top of the head. The pillow includes at least one internal armature that is flexible and bendable such that the pillow can be manipulated into a selected configuration with manual force. The armature is sufficiently strong while being malleable such that the pillow can be configured from a substantially flat configuration and into a substantially "U" shape where left and right edges are on the sides of the user's face. In the "U" shaped configuration, the user can roll 180° from side to side while maintaining support for both the neck and head while, at the same time, allowing user to maintain neck and head position on the pillow. Therefore, as the user rotates their head from side-to-side the pillow moves in accord and in alignment with their head rotation providing comfort and support throughout this 180° motion while also preventing the user's head from moving to different locations on of the pillow and/or disengaging their head off from the pillow and thereby providing a more therapeutic and comfortable rest or sleep.

DETAILED DESCRIPTION OF ILLUSTRATIVE EMBODIMENTS

Figure 1:
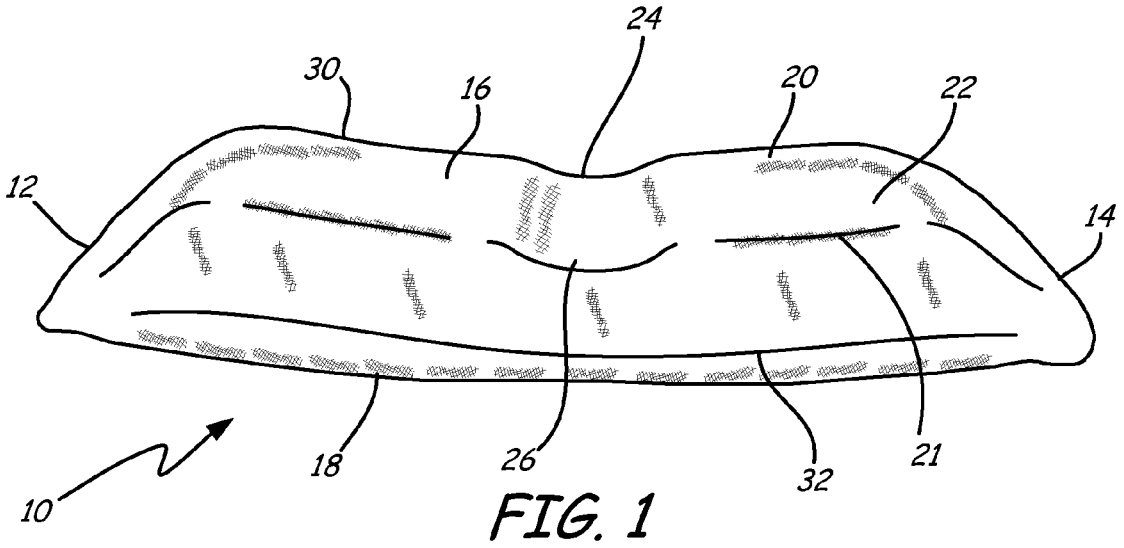
FIG. 1 is a perspective view of the pillow in a substantially flat configuration.

A pillow is generally illustrated in FIG. 1 at 10. The pillow 10 is designed to support the user's head and neck while resting while being able to be configured into an infinite number of configurations from substantially flat where a horizontal plane intersect the length of the pillow from a left edge 12 to a right edge 14 to configuring the pillow 10 to be doubled over such that left and right edges 12 and 14 of the pillow 10 are substantially one on top of the other.

The pillow 10 can have numerous dimension including that of a typical standard pillow (20 inches by 26 inches), a typical queen size pillow (20 inches by 30 inches) or a typical king size pillow (20 inches by 36 inches). When covered by a pillowcase, the pillow 10 can have the appearance of a standard flat pillow. However, the pillow 10 can also have a smaller configuration that can be used for travelling.

Figure 2:
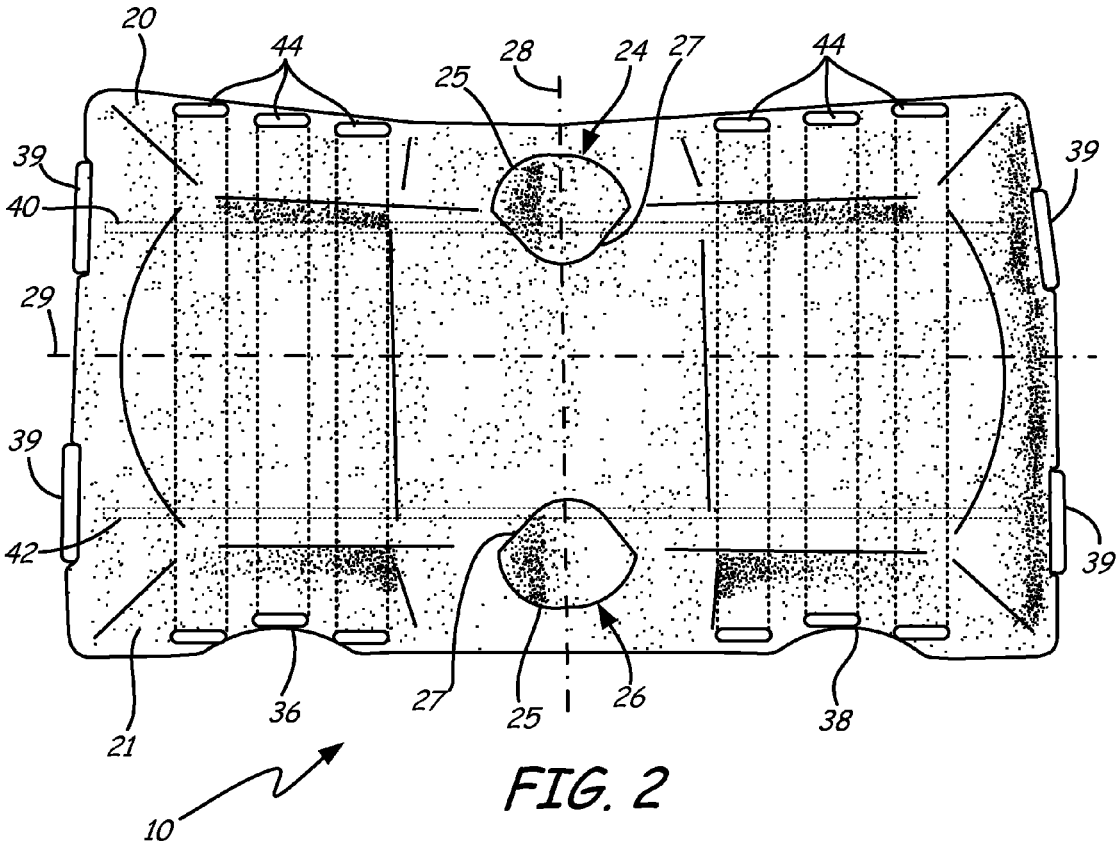
FIG. 2 is a top view of the pillow.
Figure 3:
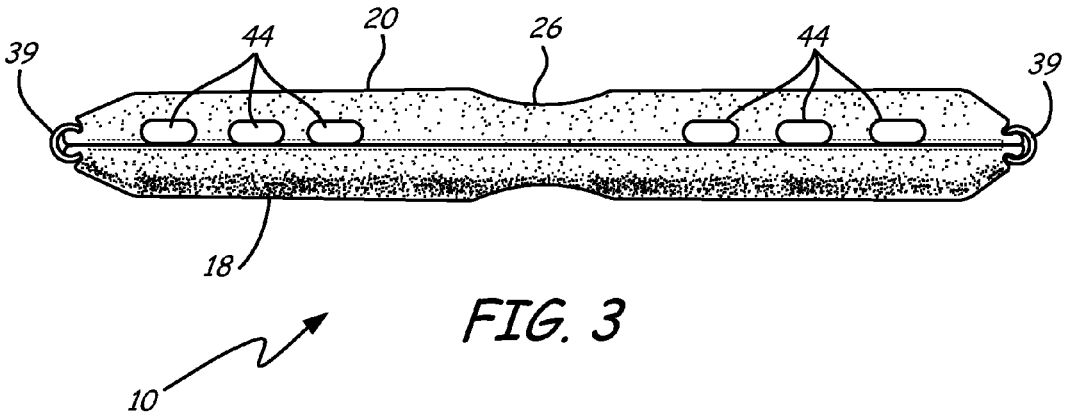
FIG. 3 a side view of the pillow

Referring to FIGS. 1-3, the pillow 10 includes an upper surface 16 and a lower surface 18 which the person uses to support his/her neck and head. The upper surface 16 includes raised edges 20 and 21 proximate the upper and lower edges of the upper surface 16 where the raised edges 20 and 21 slope to a recessed surface 22. The recessed surface 22 is substantially flat or concave and extends from proximate the left edge 12 of the pillow 10 to proximate the right edge 14 of the pillow.

The upper surface includes upper and lower cutouts 24 and 26 that intersect the raised edged 20 and 21 wherein the cutouts 24 and 26 are in communication with the recessed surface 22. The cutouts 24 and 26 provide support to the user's neck without causing flexure in the thoracic/cervical region of the person's body that can be caused by a typical pillow and the recessed surface 22 provides support for the user's head.

The upper and lower cutouts 24 and 26 are aligned along a vertical axis 28 of the pillow 10 such that the person can use the pillow 10 with either a top edge 30 or a bottom edge 32 proximate the user's shoulders. The upper and lower cutouts 24 and 26 have an arcuate bottom edge 25 that accepts the base of the user's neck. The upper and lower cut outs 24 and 26 also include an arcuate top edge 27 that accepts the neck proximate the head. The bottom arcuate edge 25 is larger than the top arcuate edge 27 to accommodate the typical anatomy of a person where the base of the neck is typically wider than the upper portion of the neck. However, the cutouts can be of any dimension provided that each cut out 24 and 26 provides adequate support for user's neck without causing flexure of the cervical and/or thoracic region of the user's neck. While an upper and lower cut out 24 and 26 are described and illustrated, it should be understood that a pillow with only one cut out for the neck is contemplated.

The recessed surface 22 is of an adequate size and shape to support the back of the user's cranium and side of the head such that the muscles and bones in the neck, including the thoracic and cervical region, are not required to support the user's head. Because the neck and the back portion of the cranium are supported by the cut outs 24 or 26 and the recessed surface 22, the user's head and neck are positioned in an anatomically correct position without unwanted flexure, stress or strains, the user can obtain a more beneficial sleep with the pillow 10 disclosed herein.

The lower surface 18 is typically flat. However it is contemplated that the lower surface 18 can include the same configuration as the top surface including the raised edges 20 and 21, the recessed surface 22 and the cutouts 24 and 26.

The bottom edge 32 can optionally include spaced apart indentions 36 and 38 at substantially an equal distance from the vertical axis 28. The optional indentions 36 and 38 are configured to conform to the shoulder/trapezius/clavicle region of the person to provide additional comfort to the person when the pillow 10 is wrapped around the user's head while the user is in a seated, upright and/or reclined position.

Figure 5:
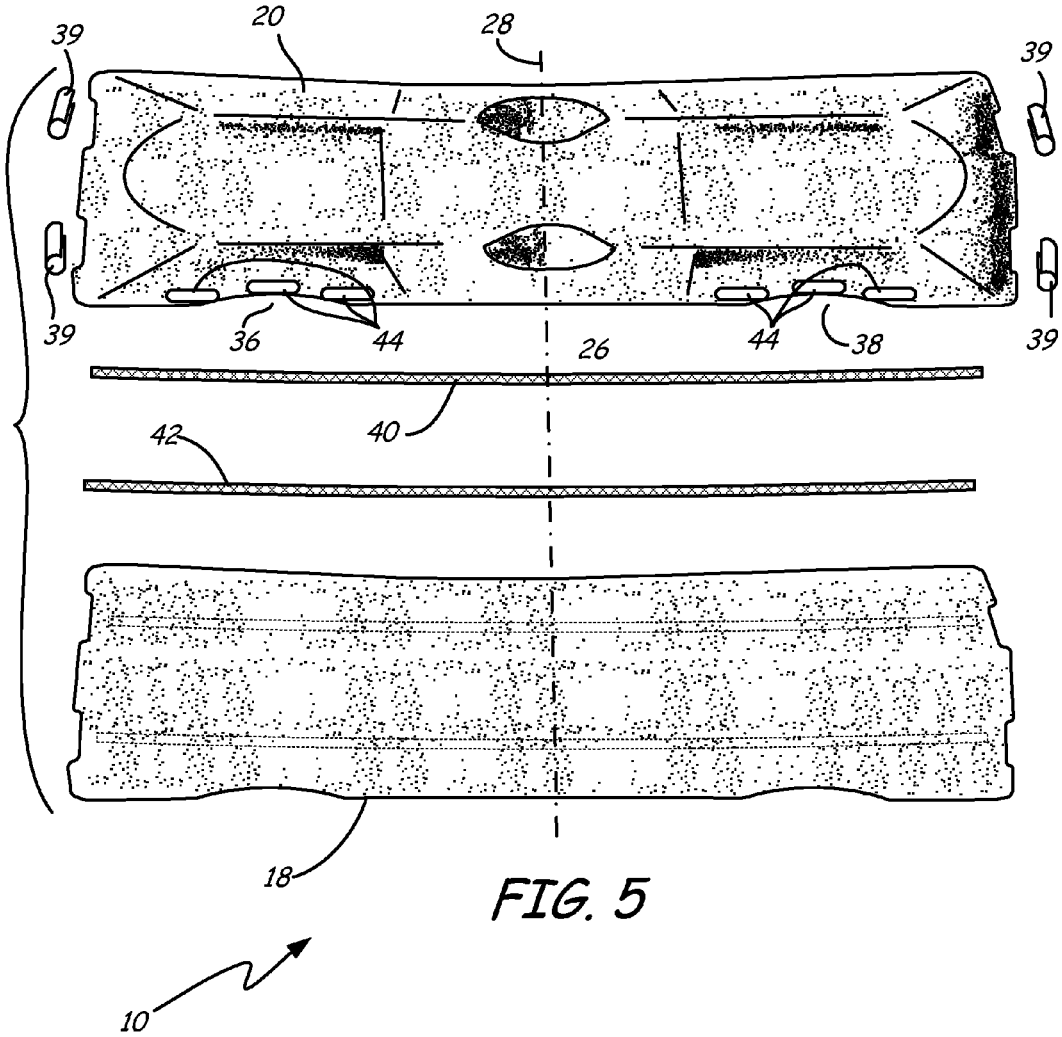
FIG. 5 is an exploded view of a two layer pillow.

Referring to FIGS. 2 and 5, the pillow 10 includes a top armature 40 and a bottom armature 42 that are positioned within an interior of the body of the pillow 10. The body of the pillow 10 is typically a foam type material such that through bores or holes can be made the body and the armatures 40 and 42 are positioned therein. The openings are then closed with single and/or multiple clips and/or covers 39 to prevent the armatures 40 and 42 form exiting out of the body of the pillow. The clips and/or covers 39 also provide structures for the user to easily grip the pillow 10 or for configuring the pillow 10 to a desired configuration. The armatures 40 and 42 are typically positioned in the body of the pillow 10 such that the armatures 40 and 42 are substantially parallel to the axis 29. The armatures 40 and 42 are flexible and bendable and retain the shape into which they are bent. However, the armatures may have other positional and angular arrangements such as criss-crossing, curvatures and/or non-parallel configurations that influence the functional bendability of the pillow. The armatures can also be located in different horizontal planes in reference to the plane along the lower surface 18 when substantially flat.

The armatures 40 and 42 are typically a flexible steel tube that are commonly referred to as goose-neck or conduit tubing. Flexible steel tubing, including typical goose neck tubing, has intermeshed round coils and coils with flat surfaces, provide the necessary strength, conformity, rigidity and flexibility to configure the pillow into any desired configuration. One manufacturer of the flexible steel tubing is Uniprise International, Inc. located in Terryville, Conn. The flexible steel tubes are easily bendable and when being bent do not make sounds. It has been discovered that due to the closeness of the person's ear to the armature, that any sound is easily noticed and can disrupt the user's rest or sleep.

However, other types of armatures are also contemplated including plastic-like rods and/or multi-jointed and/or hinged rods with interlocking segments where the segments move to selected positions and retain the selected configuration. Whatever armature is utilized, the armature must have sufficient flexibility and strength to be manipulated with manual force into a selected position and to retain the position.

The pillow can also optionally include aeration conduits 44. As illustrated the pillow 10 includes two sets of three aeration conduits 44 that are positioned on opposite sides of the vertical axis 28. The aeration conduits 44 aid in removing heat from the pillow generated by the person which assist in keeping the person's head cool. The aeration conduits 44 are optional. The aeration conduits 44 can span the entire pillow, or partially penetrate through the main body of the pillow 10.

The aeration conduits 44 can take other configurations and be positioned at various entry points on the pillow than what is illustrated. However, configuring the conduits 44 are typically orthogonal to the armatures 40 and 42 minimizes the pillow's compressing resistance against the foam and armatures 40 and 42 from being bent and therefore the manipulation of the pillow 10 to a selected configuration is easily manageable by the user.

The aeration conduits 44 are typically cut out of the main body of the pillow. However the aeration conduits can also be a metal or plastic tubing. The aeration conduits 44, especially when formed by removing material from the main body, allow for greater and easier compressibility, anatomical conformity and flexibility of the pillow 10, that's also useful for compressing and/or rolling up for a more compact storage size.

The pillow 10 is typically constructed from two layers of material, where the bottom material retains the armatures 40 and 42 and the upper layer includes the aeration conduits 44 and the two layers are then glued and/or sealed together. It is also contemplated that the main body of the pillow be of a monolithic construction where the pillow is created by pouring a material such as foam or any latex-like materials into a mold. It also contemplated to have a pillow of three or more attached layers or that additional pillow material be utilized to increase the thickness of the pillow.

While a foam material is contemplated other materials for the pillow could also be utilized such as beads and latex materials. Further, the pillow 10 could optionally include a single or multiple air bladders that can be expanded and contracted by inflating and deflating air from the pillow for storage and travel purposes and as well as to adjust the firmness and anatomical contour of the pillow.

Figure 4:
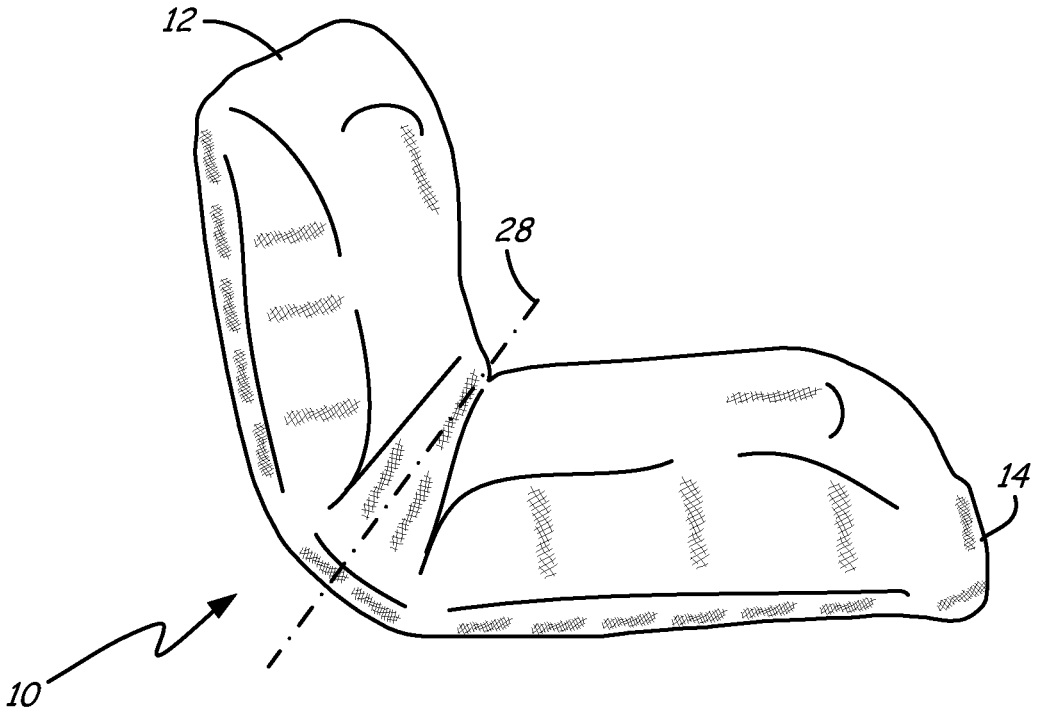
FIG. 4 is a perspective view of the pillow with a pillowcase where the pillow is in a 'L-shape' bent configuration.

Referring to FIGS. 1 and 4, the pillow 10 can be manipulated into many different configurations. The pillow 10 is illustrated as being substantially flat in FIG. 1. Referring to FIG. 4, the armatures 40 and 42 are manipulated to configure the pillow 10 into a substantially "L" shaped configuration wherein the armatures 40 and 42 are bent substantially along the axis 28. It should also be noted that the armatures 40 and 42 are sufficiently flexible to allow the pillow 10 to be folded over onto itself.

Referring to FIGS. 6 and 7A-C, the pillow 10 can also be configured into a substantially "U" shape where a cavity 50 is formed to accept, surround and support a person's head. In the substantially "U" shaped configuration, the pillow 10 is of a sufficient size such that the top edge 20 of the pillow extends substantially even with or above the top of the person's ears and cranium and the left and right edges 12 and 14 of the pillow 10 are even with or in front of the person's face. With the edges 12 and 14 in front of the user's face, light is blocked from the user's eyes. A shade can optionally be attached to the edges 12 and 14 to further block light from the user's eyes.

Figure 7A:
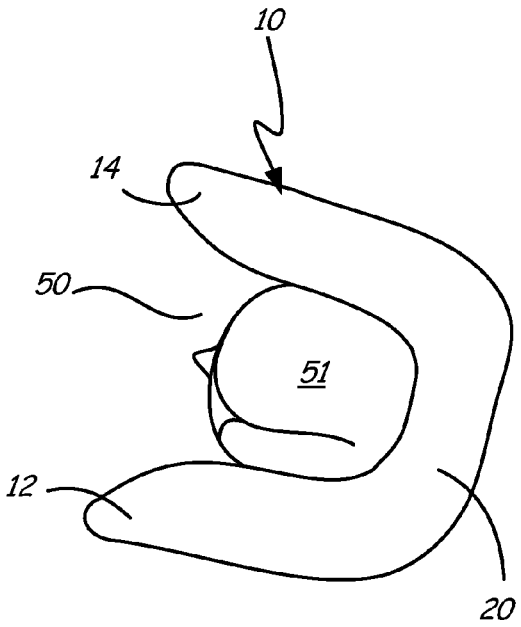
FIGS. 7A-7C are a sequence of perspective views illustrating the pillow and the user's head moving from side to side.
Figure 7B:
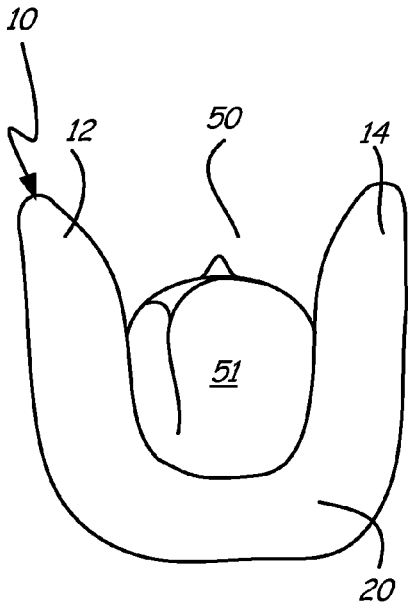
Figure 7C:
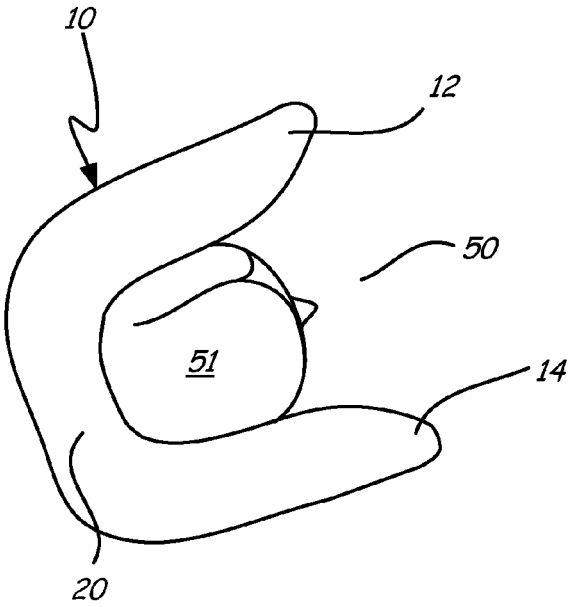

As illustrated in FIGS. 7A-7C, with the pillow 10 in the substantially "U" shaped configuration, the user's head 51 fits within the cavity 50 where the left and right edges 12 and 14 are in front of the user's face and the top edge 20 is above the user's head 51. The user can roll 180° where the left side of the user's head 51 is proximate a resting surface as illustrated in FIG. 7A, to where the back of the head 51 is proximate the resting surface as illustrated in FIG. 7B, to where the right side of the head 51 is proximate the resting surface as illustrated in FIG. 7C. The pillow 10 allows for side to side movement while maintaining support for both the neck and head while, at the same time, allowing user to maintain neck and head position on the pillow. Therefore, as the user rotates their head 51 from side-to-side the pillow 10 moves in accord and alignment with the rotation of the user's head 51 and provides comfort and support throughout this 180° motion while also preventing the user's head 51 from moving to different locations on the pillow 10 and/or disengaging their head off from the pillow 10 and thereby provide a more therapeutic and comfortable rest or sleep.

The configuration of the pillow 10 provides several advantages over the prior art pillows. One such advantage of the pillow 10 is the fact that the neck and the head rest within cut outs 24 or 26 and the recessed surface 28 so as to maintain an aligned position of the cranium and neck in both a static position and also when moved from side to side, when a person is prone or in a seated upright and/or reclining position when resting, reading, watching TV, sleeping or any other activity where the body is trying to rest or sleep. As such, the head of the user of the pillow 10 will have a more supported sleep posture in all positions; upright, prone, linear and side-to-side, than a typical pillow and also will maintain the proper alignment of the neck and head such that aches and pains and sleeping disturbances are minimized or eliminated that can result from using a U-shaped pillow that only extends around the back and sides of the neck up to the bottom base of the head when sleeping or when rolling off of a flat pillow.

An additional benefit of the pillow 10 is that when configured into either a left-side or right-side "L" or "U" shape position the head of the user is surrounded by the noise-reducing material(s) the foam provides while the user's ears are surrounded with this material(s) which muffles sound. Further, because the pillow 10 extends beyond the user's face when configured into either a left-side or right-side "L" or "U" shape position, the pillow 10 blocks at least some light from hitting the user's face during sleep which would also increase the quality and duration of the user's sleep.

Besides being useful as a pillow on a bed, the pillow 10 is also useful in providing support and comfort to a user while sitting or reclining on other furniture. The pillow 10 can be utilized as a cradle or support to retain a heating or cooling pad in a desired location on the user's body while conforming to the particular region on the body.

Figure 8:
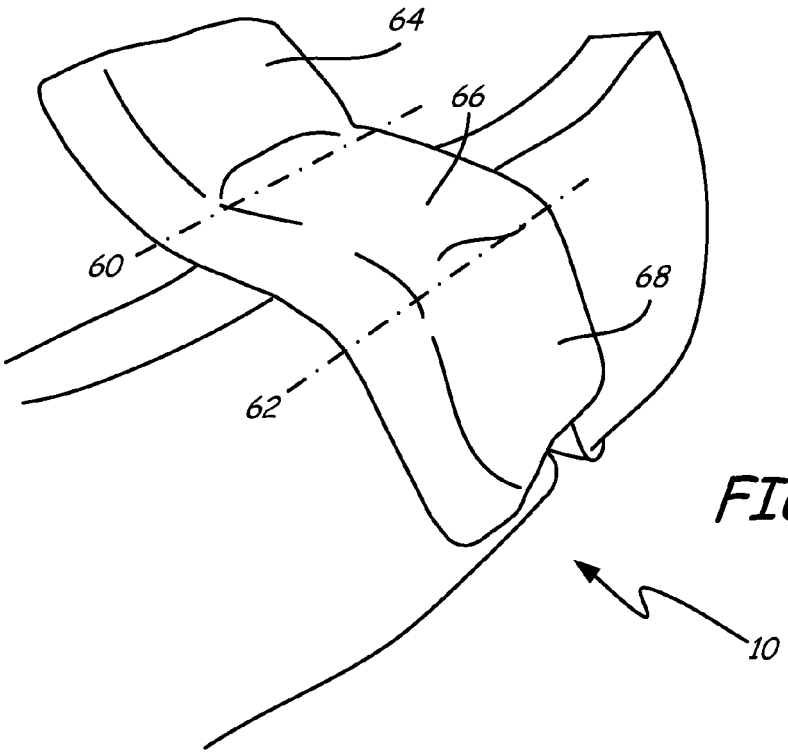
FIG. 8 is a perspective view of another 'S-shape' configuration of the pillow positioned on a couch.
Figure 9:
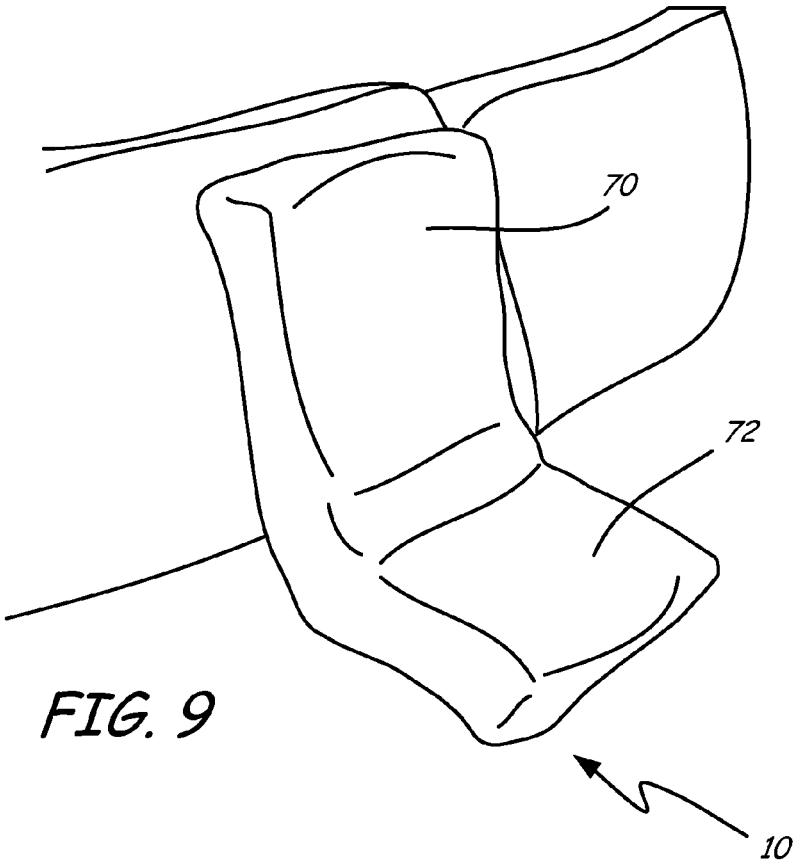
FIG. 9 is an 'L-shape' configuration perspective view of the pillow positioned on a couch while resting on the floor.
Figure 10:
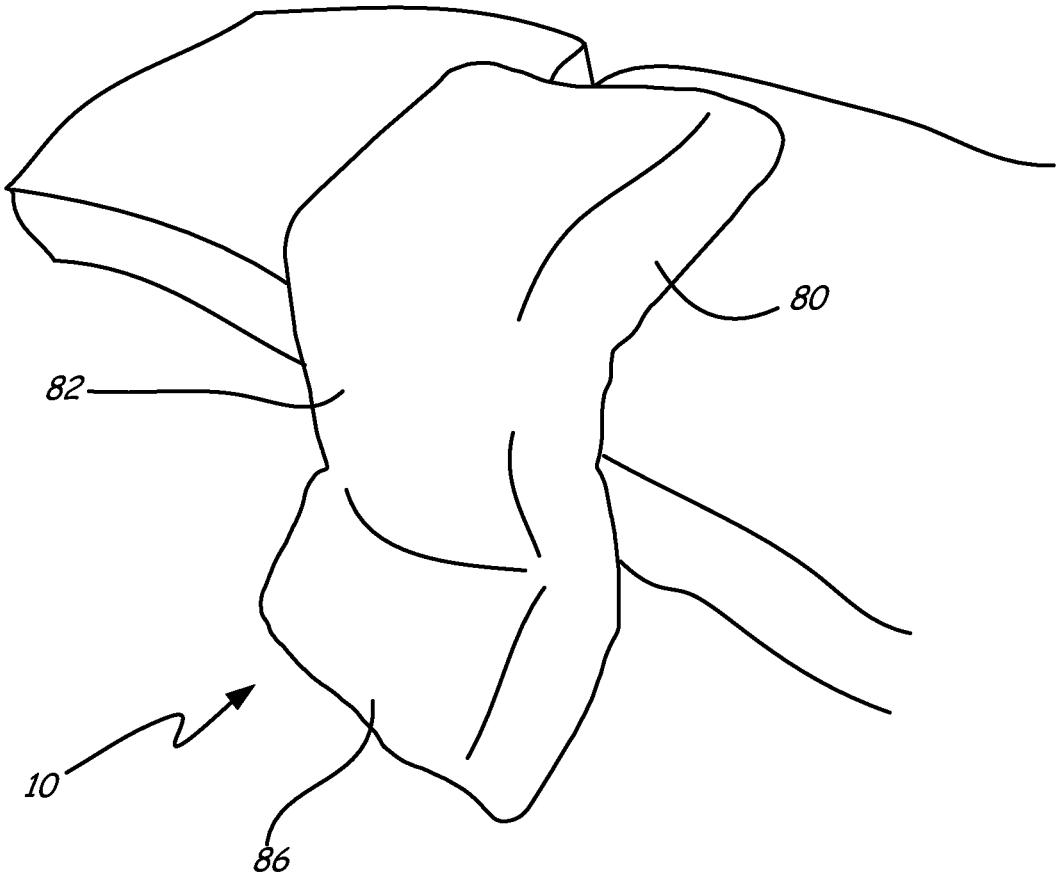
FIG. 10 is another perspective 'S-shape' configuration view of the pillow positioned on top of a couch.

Referring to FIGS. 8-10, the flexibility and manipulabity of the pillow 10 are illustrated as conforming to different configurations on a couch. Referring to FIG. 8, the pillow 10 is illustrated in a substantially "S" shaped configuration having two separate flexing planes 60 and 62 to form three sections 64, 66 and 68 respectively, such that the pillow can conform to a back rest of a sofa or couch where the pillow 10. The pillow 10 as configured in FIG. 8 provides cervical, thoracic and lumbar support.

Referring to FIG. 9, the pillow 10 is illustrated in a substantially "L" shaped configuration positioned on both the back rest and seating surface of the couch where the pillow 10 has an upright portion 70 that conforms to the back rest and substantially horizontal portion 72 that conforms to the seating surface. The pillow 10 as configured in FIG. 9 provides pelvic, hip, thoracic and lumbar support.

Referring to FIG. 10, the pillow 10 is illustrated in another type of substantially "S" shaped configuration where a top portion 80 is positioned on cushions of the couch, a middle portion 82 is positioned adjacent the front of the couch and a bottom portion 86 is positioned on the floor. In the "S" shaped configuration the pillow 10 provides pelvic, hip lumbar and thoracic support.

Figure 11:
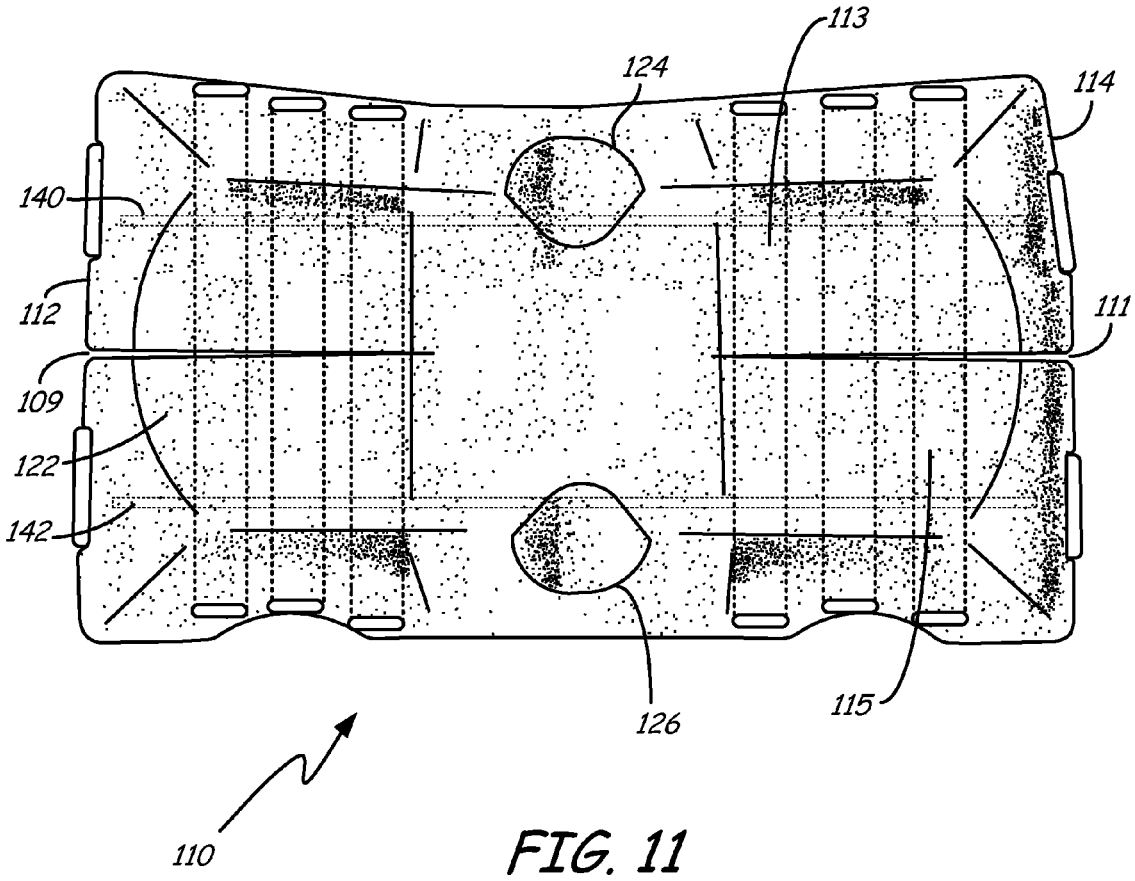
FIG. 11 is a top view of another configuration of the pillow.

Referring to FIG. 11, another construction of a pillow 110 is illustrated. The pillow 110 is of a similar configuration as that of the pillow 10. However, the pillow 110 includes a left slit 109 extending inward from the left edge 112 to proximate the interior cavity 128. The pillow 110 includes a right slit 111 extending inward from the right edge 114. The slits 109 and 111 are located between the upper and lower armatures 140 and 142, such that the armatures 140 and 142 are within an upper portion 113 of the pillow 110 and a lower portion 115 of the pillow 110, respectively. With the armatures 140 and 142 within the upper and lower portions 113 and 115, respectively, the upper and lower portions 113 and 115 can be manipulated simultaneously or independent of each other, depending upon the user's desired configuration.

Figure 6:
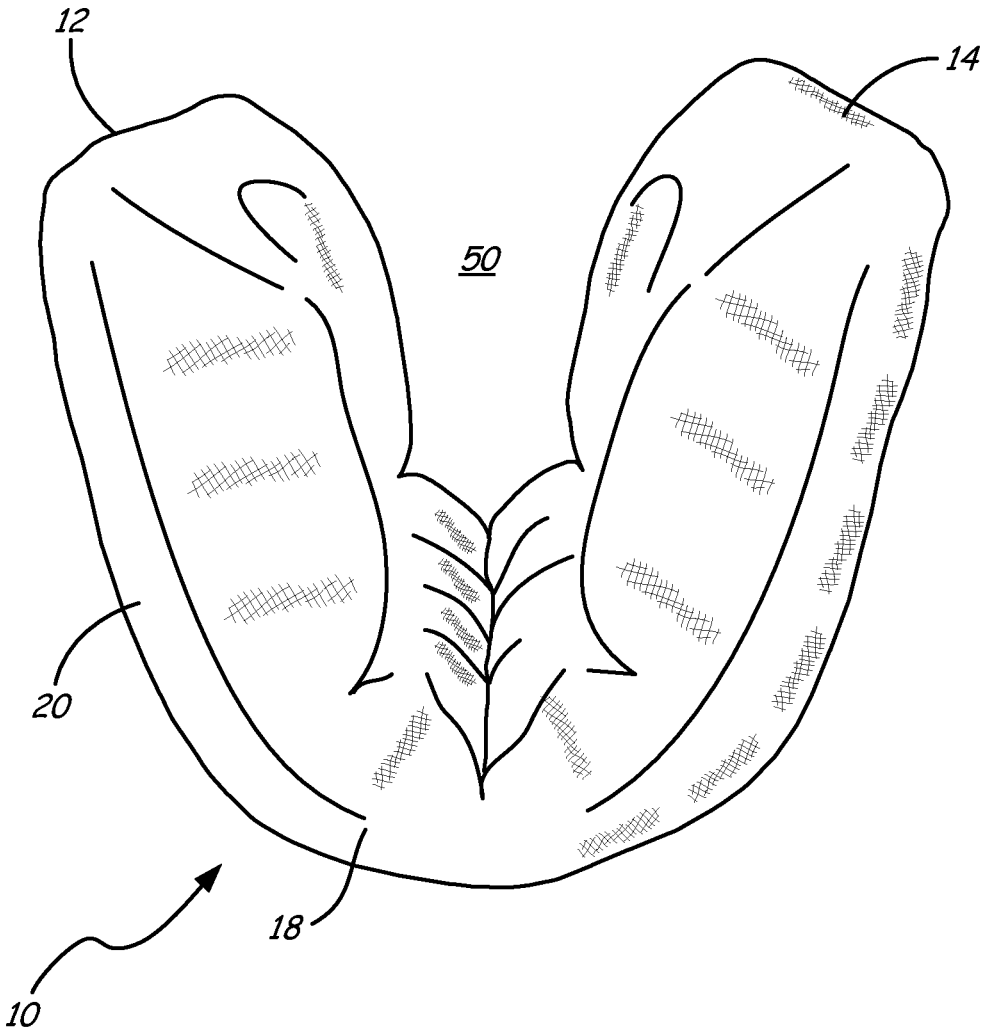
FIG. 6 is a perspective view of the pillow with a pillowcase in a substantially "U"-shaped configuration.
Figure 12:
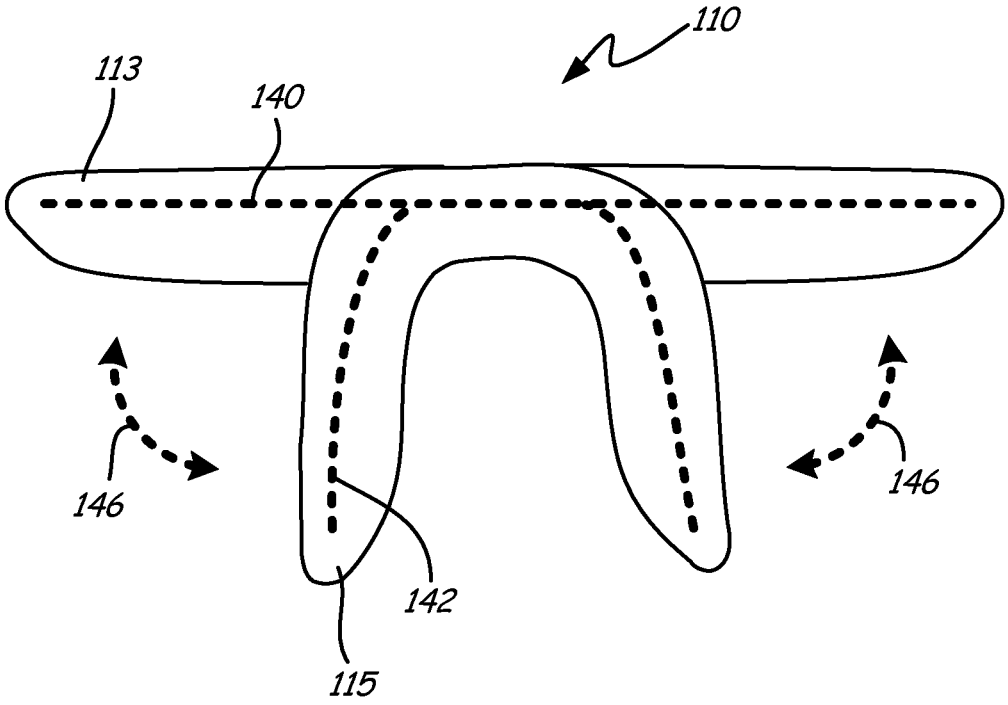
FIG. 12 is side view of the pillow of illustrated in FIG. 11 where a bottom portion is substantially "U" shaped and the top portion is substantially flat.

The upper and lower sections 113 and 115 of the pillow 110 can be laid flat such that the pillow has the configuration of a conventional flat pillow. The upper and lower sections 113 and 115 can also be manipulated to from a substantially "U" shaped pillow as illustrated in FIG. 6. The upper section 115 can be manipulated independently and/or simultaneously to a substantially "U" shaped configuration to provide support to the head while the lower section 113 is substantially flat illustrated by arrows 146 in FIG. 12. The pillow 110 can also be manipulated to wrap the lower section 115 about the user's neck while the upper section 113 is substantially flat.

The upper and lower sections 113 and 115 can also be configured into numerous other configurations. As such, the pillow 110 with the slits 109 and 111 can provide further flexibility in configuring the pillow 110 the need of the user.

Although the present invention has been described with reference to preferred embodiments, workers skilled in the art will recognize that changes may be made in form and detail without departing from the spirit and scope of the invention.

The invention claimed is:

1. A pillow having a height to extend from the user's lower neck/shoulders region to proximate the top of the user's head and a length sufficient to extend from behind the user's head to extend to or surpass the front of the user's face when folded in half, the pillow comprising:

a main body having a top surface, a substantially uninterrupted lower surface, a left edge, a right edge, a top edge and a bottom edge wherein the top surface comprises:

first and second raised edges proximate a top edge and a bottom edge of the top surface, the first and second raised edges extending from proximate the left edge to proximate the right edge and a recessed surface between the first and second raised edges; and a first cutout extending from the bottom edge and through the first raised edge and being in communication with the recessed surface and wherein the first cutout is configured such that a first portion of the main body that defines the first cutout is configured to engage and support a user's neck from the bottom edge and into and the recessed surface wherein the recessed surface is configured to support the user's head; and spaced apart first and second flexible armatures positioned within the main body and being substantially parallel to each other, and wherein the first and second flexible armatures are constructed to be independently manipulated to a desired configuration with manual force and maintain the desired configuration without additional force.

2. The pillow of claim 1 and wherein the top surface comprises a second cutout spaced apart from the first cutout and extending from the top edge and through the second raised edge and being in communication with the recessed surface and wherein the second cutout is configured such that a second portion of the main body that defines the second cutout is configured to engage and support a user's neck from the top edge and into the recessed surface and wherein the first and second cutouts are aligned.

3. The pillow of claim 2 and wherein the first and second cutouts are aligned along a first axis of the pillow.

4. The pillow of claim 1 and wherein the first and second flexible armatures comprise steel tubes with intermeshing coils.

5. The pillow of claim 1 and further comprising at least one aeration conduit extending from a left edge, a right edge, a top edge or a bottom edge and into the main body to circulate air into the main body and to remove heat and to provide anatomical contouring compressibility to the users' neck, face and head, and to reduce the resistance onto the armatures for easier bending and flexing the pillow.

6. The pillow of claim 5 and wherein the at least one aeration conduit extends through the main body from the top edge to the bottom edge of the pillow.

7. The pillow of claim 1 and wherein the first and second armatures are flexible steel and/or synthetic material rods or tubes.

8. A pillow having a height to extend from the user's shoulders to proximate the top of the user's head and a length sufficient to extend from behind the user's head to proximate the front of the user's face when folded in half, the pillow comprising:

a main body having an upper surface, a lower surface, a left edge, a right edge, a top edge and a bottom edge; and substantially parallel spaced apart first and second flexible armatures positioned within the main body wherein each of the first and second flexible armatures are constructed to be independently manipulated to a desired configuration with manual force and maintain the desired configuration without additional force and wherein the upper surface comprises: first and second raised edges proximate a top edge and a bottom edge of the upper surface and a recessed surface between the first and second raised edges; and a first cutout extending from the bottom edge, through either the first or second raised edge and being in communication with the recessed surface and wherein the first cutout is configured to support a user's neck and the recessed surface is configured to support the user's head.

9. The pillow of claim 8 and wherein the first and second armatures are flexible steel and/or synthetic material rods or tubes.

10. The pillow of claim 8 and wherein the upper surface comprises a second cutout spaced apart from the first cutout and extending from either the top edge or the bottom edge and through the other raised edge and being in communication with the recessed surface and wherein the second cutout is configured to support a user's neck and wherein the first and second cutouts are aligned.

11. The pillow of claim 10 and wherein the first and second cutouts are aligned along a first axis of the pillow.

12. The pillow of claim 8 and further comprising at least one aeration conduit extending from a left edge, a right edge, a top edge or a bottom edge and into the main body to circulate air into the main body and to remove heat.

13. The pillow of claim 12 and wherein the at least one aeration conduit extends through the main body from the top edge to the bottom edge of the pillow.

14. A pillow having a height to extend from the user's shoulders to proximate the top of the user's head and a length sufficient to extend from behind the user's head to proximate the front of the user's face when folded in half, the pillow comprising:

a main body having an upper surface, a lower surface, a left edge, a right edge, a top edge, a bottom edge, a first axis and a second axis substantially perpendicular to the first axis; and spaced apart first and second flexible armatures positioned internally within the main body wherein each of the first and second flexible armatures are constructed to be independently manipulated such that the pillow can be positioned into a coil in either a direction of the first axis or in a direction on the second axis and wherein the upper surface comprises: first and second raised edges proximate a top edge and a bottom edge of the upper surface and a recessed surface between the first and second raised edges; and a first cutout extending from the bottom edge, through either the first or second raised edge and being in communication with the recessed surface and wherein the first cutout is configured to support a user's neck and the recessed surface is configured to support the user's head.

15. The pillow of claim 14 and wherein the first and second armatures are flexible steel and/or synthetic material rods or tubes.

16. The pillow of claim 14 and further comprising at least one aeration conduit extending from a left edge, a right edge, a top edge or a bottom edge and into the main body to circulate air into the main body and to remove heat.

17. The pillow of claim 16 and wherein the at least one aeration conduit extends through the main body from the top edge to the bottom edge of the pillow.

18. The pillow of claim 14 and wherein the first and second flexible armatures comprise steel tubes with intermeshing coils.

* * * * *